US006922171B2

(12) United States Patent
Annamaa et al.

(10) Patent No.: US 6,922,171 B2
(45) Date of Patent: Jul. 26, 2005

(54) PLANAR ANTENNA STRUCTURE

(75) Inventors: Petteri Annamaa, Oulu (FI); Jyrki Mikkola, Kempele (FI)

(73) Assignee: Filtronic Lk Oy, Kempele (FI)

( * ) Notice: Subject to any disclaimer, the term of this patent is extended or adjusted under 35 U.S.C. 154(b) by 0 days.

(21) Appl. No.: 09/792,354

(22) Filed: Feb. 23, 2001

(65) Prior Publication Data

US 2001/0048391 A1 Dec. 6, 2001

(30) Foreign Application Priority Data

Feb. 24, 2000 (FI) ..... 20000437

(51) Int. Cl.[7] ..... H01Q 1/24
(52) U.S. Cl. ..... 343/700 MS; 343/702
(58) Field of Search ..... 343/700 MS, 829, 343/846, 702

(56) References Cited

U.S. PATENT DOCUMENTS

| | | | | |
|---|---|---|---|---|
| 4,791,423 A | * | 12/1988 | Yokoyama et al. | 343/700 MS |
| 4,821,040 A | * | 4/1989 | Johnson et al. | 343/700 MS |
| 4,849,765 A | | 7/1989 | Marko | |
| 4,929,961 A | | 5/1990 | Nakase | |
| 5,220,335 A | * | 6/1993 | Huang | 343/700 MS |
| 5,434,579 A | | 7/1995 | Kagoshima et al. | |
| 5,680,144 A | * | 10/1997 | Sanad | 343/700 MS |
| 5,786,793 A | * | 7/1998 | Maeda et al. | 343/700 MS |
| 6,008,764 A | * | 12/1999 | Ollikainen et al. | 343/700 MS |
| 6,140,966 A | * | 10/2000 | Pankinaho | 343/700 MS |
| 6,252,554 B1 | * | 6/2001 | Isohatala et al. | 343/700 MS |

FOREIGN PATENT DOCUMENTS

| | | | |
|---|---|---|---|
| EP | 0 332 139 A2 | 9/1989 | |
| EP | 0 790663 | 8/1997 | H01Q/1/24 |
| EP | 0 831547 | 4/1998 | H01Q/9/04 |
| EP | 0 831548 | 4/1998 | H01Q/9/04 |
| EP | 1 024 552 A2 | 8/2000 | |
| EP | 1 139 490 A1 | 10/2001 | |
| WO | WO 98/38694 A1 | 9/1998 | |
| WO | WO-99/03166 A1 | 1/1999 | |
| WO | WO-01/24314 A1 | 4/2001 | |

OTHER PUBLICATIONS

European Search Report; EP 01 66 0016; Documents considered to be relevant.

"Improved analysis method for broadband rectangular microstrip antenna geometry using E–plane gap coupling," Cho, YK, Electronics Letters, Oct. 28, 1993, vol. 29, No. 22, pp. 1907–1909.

* cited by examiner

*Primary Examiner*—Tho Phan
(74) *Attorney, Agent, or Firm*—Darby & Darby

(57) ABSTRACT

The invention relates to planar antennas the structural components of which include a parasitic element. The antenna structure comprises a PIFA-type structure (230, 210, 202) to be placed inside the covers of a mobile station. The PIFA is fed parasitically e.g. through a conductive strip (240) placed on the same insulating board. The feed conductor (203) of the whole antenna structure is in galvanic contact with this feed element; a short-circuit point the feed element doesn't have. The feed element (240) also serves as an auxiliary radiator. The resonance frequencies of the antenna elements or their parts are arranged according to need so as to overlap, to be close to each other or to be relatively wide apart. The structure may also comprise a whip element in connection with the feed element. According to the invention, a relatively simple structure provides a reliable dual resonance and, hence, a relatively wideband antenna when the resonances are close to each other. Moreover, no polarization rotation takes place in the antenna radiation inside the frequency band realized through the dual resonance.

7 Claims, 4 Drawing Sheets

100

PLANAR ANTENNA STRUCTURE

FIELD OF INVENTION

The invention relates to planar antennas the structural parts of which include a parasitic element. The antenna finds particular utility in mobile stations which require a relatively wide band or which are to be used in two or more frequency bands.

BACKGROUND

In portable radio apparatuses, especially in mobile stations, the antenna requirements have become more severe. As the devices continue to shrink in size, the antenna naturally has to be small; preferably it is placed inside the covers of the apparatus. On the other hand, together with the introduction of new frequencies there has been a growing demand for mobile stations in which the antenna must function in two or more frequency bands. In addition, in dual-band antennas the upper operating band at least should be relatively wide, especially if the device in question is to be used in more than one system utilizing the 1.7 to 2-GHz range.

Antenna requirements may be met through various structural solutions. The solution according to the present invention is based on the application of a parasitic element in planar antennas. Several such structures are known in the art. Typically they comprise a printed circuit board with a ground plane on one surface and a conductive region connected to an antenna feed line and at least one parasitic conductive region on the other surface. Such a structure is shown in FIGS. 1*a,b*. FIG. 1*a* shows a top view of an antenna 100, and FIG. 1*b* shows a side view of a cross section of the same antenna. The structure comprises a dielectric plate 108. On the upper surface of the plate 108 there are conductive regions 120 and 130 which function as radiating elements. On the lower surface of the plate 108 there is a conductive region 110 which covers the whole surface and functions as a ground plane. The first radiating element 120 is connected at a point F through a feed conductor 102 to a source feeding the antenna. In addition, the element 120 is short-circuited to ground at a point S through conductor 103 so as to improve the electrical characteristics, such as impedance matching, of the antenna. The resulting structure is called a planar inverted F antenna (PIFA). The second radiating element 130 is parasitic, i.e. there is only an electromagnetic coupling between it and the first element 120. It, too, may have a short-circuit point. The purpose of the parasitic element is to further improve the electrical characteristics, such as bandwidth or radiation pattern, of the antenna.

One drawback of the above-described antennas according to the prior art is that their bandwidth is not always large enough for modern communications devices.

Radiating elements may be designed such that the bandwidth is increased through two adjacent resonance frequencies, but then the disadvantage of the structure is that the structure is relatively complex as regards ensuring reliable operation. An additional disadvantage of an element, which has two adjacent resonances, is that the polarization of its radiation rotates inside the band. Moreover, it is a disadvantage of the structures described above that they are sensitive to the effect of the user's hand, for example. If a finger, for instance, is placed over the radiating element of a PIFA on the outer cover of the apparatus, the operation of the PIFA will be impaired.

BRIEF SUMMARY OF THE INVENTION

An object of the invention is to reduce the above-mentioned disadvantages associated with the prior art. The antenna structure according to the invention is characterized by what is specified in the independent claim 1. Advantageous embodiments of the invention are specified in the dependent claims.

The basic idea of the invention is as follows: The antenna structure comprises a PIFA-type element to be placed inside the covers of a mobile station. The PIFA is fed parasitically e.g. through a conductive strip on the same insulating board. The feed conductor of the whole antenna structure is connected galvanically to this feed element; a short-circuit point the feed element doesn't have. At the same time the feed element serves as an auxiliary radiator. The ground plane of the antenna is a separate element located relatively far away from the radiating elements. The resonance frequencies of the antenna elements or their parts are arranged according to need so as to overlap, to be close to each other or to be relatively wide apart. The structure may also comprise a whip element in connection with the feed element.

An advantage of the invention is that with a relatively simple structure a reliable dual resonance can be achieved and, hence, a relatively wideband antenna when the resonances are close to each other. Another advantage of the invention is that a relatively large gain can be achieved for the antenna by utilizing overlapping resonances. A further advantage of the invention is that the antenna can be easily made a dual-band antenna by arranging the resonance frequencies such that they fall into the frequency bands used by the desired systems. A still further advantage of the invention is that no polarization rotation will take place in the antenna radiation inside the frequency band realized through the dual resonance. A yet further advantage of the invention is that the manufacturing costs of the structure are relatively low as it is simple and suitable for series production.

The invention is described in detail in the following. The description refers to the accompanying drawings, in which

DETAILED DESCRIPTION OF AN EXEMPLARY EMBODIMENT OF THE INVENTION

Figure 1A:
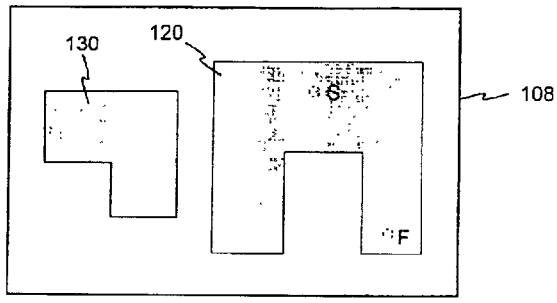
Fig. 1a PRIOR ART
FIGS. 1A and 1B show an example of an antenna structure according to the prior art.
Figure 1B:
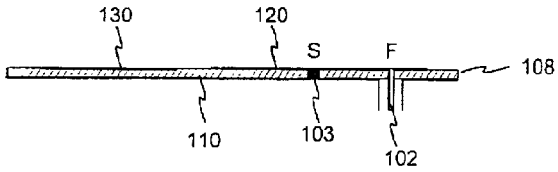

FIG. 1 was already discussed in conjunction with the description of the prior art.

Figure 2:
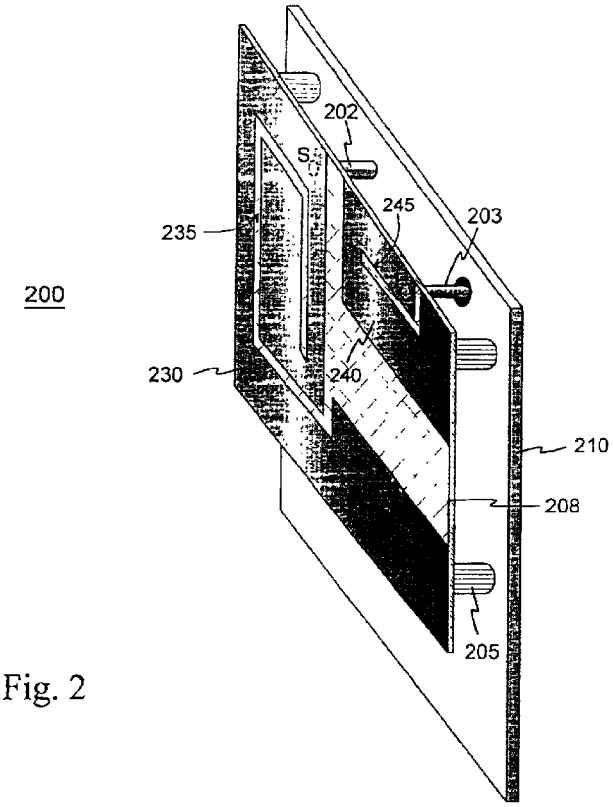
FIG. 2 shows an example of an antenna structure according to the invention.

FIG. 2 shows an example of an antenna structure according to the invention. In this example the antenna 200 comprises a ground plane 210 and a parallely positioned dielectric plate 208, attached to the ground plane through insulating pieces such as 205. On the outer surface, as viewed from the ground plane, of the dielectric plate 208 there are two separate planar conductive regions: a parasitic element 230 and feed element 240. On the ground-plane-side surface of the dielectric plate 208 there are no conductive regions. The parasitic element is short-circuited at a point S to the ground plane through conductor 202. The radiating parasitic element 230, short-circuit conductor 202 and ground plane thus constitute the PIFA-part of the antenna. The feed conductor 203 of the whole antenna structure is in galvanic contact with the feed element 240 at a point F. The feed element has two functions. It, too, serves as a radiating element and, on the other hand, it transfers energy through an electromagnetic coupling to the field of the parasitic element. Antenna characteristics are naturally dependent on the relative positions of the elements: the wider apart the elements, the smaller the bandwidth of a single-band antenna and, correspondingly, the greater the Q value.

In the example of FIG. 2 the parasitic element has a slot 235 which divides the element, viewed from the short-circuit point S, into two branches the lengths of which are not equal. The PIFA thus has got two natural frequencies. In the example depicted the feed element has a slot 245 which is used to give a desired length for the feed element, viewed from the feed point F. The frequency characteristics of the antenna depend, in addition to the length and mutual distance of the facing edges of the elements, on the resonance frequencies of the elements and on their distance from the ground plane. Each resonance frequency depends on the length of the element or its branch. With the structure of FIG. 2 it is possible to arrange the dimensions of the elements such that the resonance frequency of the longer branch of the parasitic element 230 falls into the frequency band of the GSM 900 system (Global System for Mobile telecommunications), for example, and the resonance frequencies of the shorter branch of the parasitic element and feed element fall into the frequency band of the GSM 1800 system. By taking the latter two resonance frequencies further apart from each other the corresponding frequency band gets wider until it is split into two separate frequency bands. It is substantial in the invention that the parasitic element is short-circuited but the feed element is not. Using these ways to produce adjacent resonance frequencies one can achieve relatively large bandwidths more simply than in the prior art. Another significant fact is that no polarization rotation occurs in the antenna radiation inside the frequency band realized by means of the dual resonance, unlike in corresponding structures according to the prior art.

Figure 3:
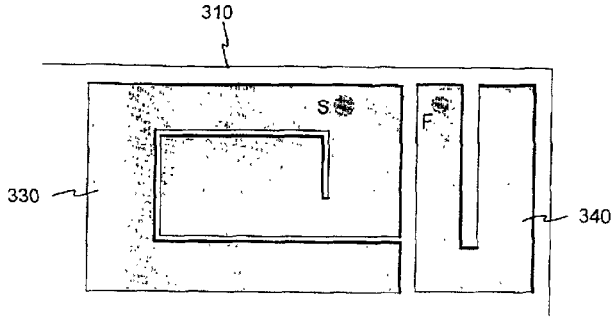
FIG. 3 shows another example of an antenna structure according to the invention.

FIG. 3 shows another example of an arrangement according to the invention. It comprises a planar feed element 340, planar parasitic element 330 and, behind those, a ground plane 310. In this example, too, the parasitic element includes a slot which divides the plane, viewed from the short-circuit point S, into two unequally long branches so as to produce a dual-band antenna. The feed conductor of the whole antenna structure is at point F in galvanic contact with the feed element 340. The difference from the structure of FIG. 2 is that now the parasitic element and feed element are not conductive regions on the surface of a dielectric plate but discrete and rigid conductive bodies.

Figure 4A:
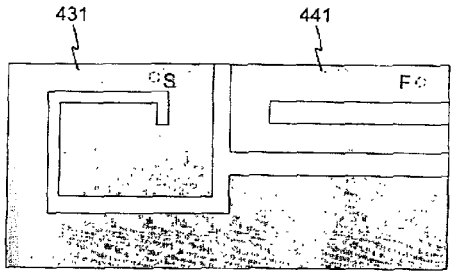
FIGS. 4A, 4B, 4C and 4D show other examples of antenna element design.
Figure 4B:
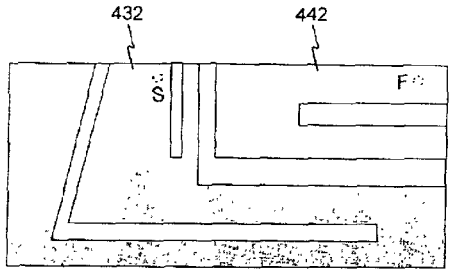
Figure 4C:
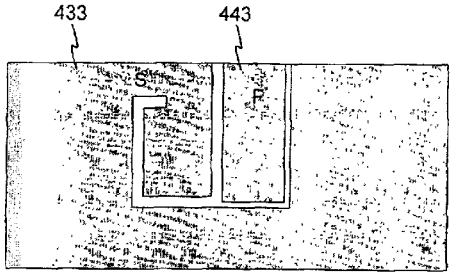
Figure 4D:
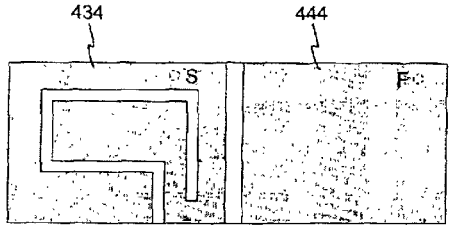

FIGS. 4*a–d* show additional examples of antenna element design according to the invention. In each of the FIGS. 4*a*, 4*b* and 4*c* the parasitic element 431; 432; 433 is a dual-frequency element and the feed element 441; 442; 443 has dimensions such that its resonance frequency comes relatively close to the upper resonance frequency of the parasitic element. The ground plane, not shown, is at a distance that equals a little less than half of the shorter side of the rectangle formed by the radiating elements. These structures are suitable for communications devices designed to function in the GSM 900 and GSM 1800 systems, for example. In FIG. 4*d* the parasitic element 434 has got two branches as well. Now, however, the structural dimensions of both said parasitic element and the feed element are chosen such that all resonance frequencies of the antenna fall into the frequency band 1900 to 2170 MHz allocated to the Universal Mobile Telecommunication System (UMTS), for example.

Figure 5:
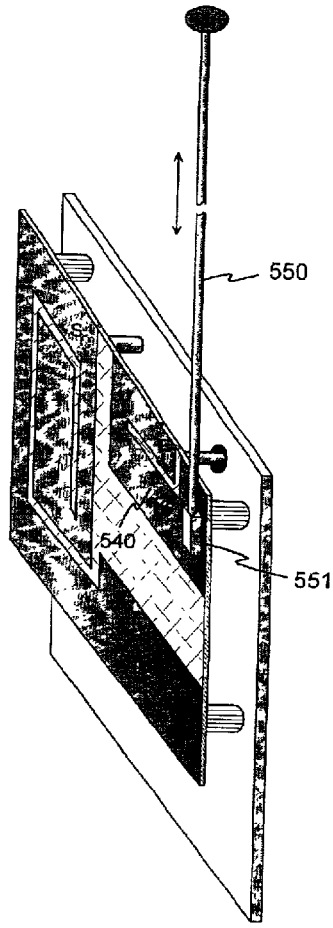
FIG. 5 shows an antenna according to the invention with an additional whip element.

FIG. 5 shows an embodiment in which an antenna according to the invention is supplemented with a whip element. The basic structure is similar to that of FIG. 2. In addition, there is a whip element 550, shown in its extended position. In this example it is thus in galvanic contact with the feed element 540 through a connection piece 551. The mechanism that presses the connection piece against the feed element is not shown. The whip is coupled to that end of the feed element which is opposite to the feed point F. By means of the feed element can be arranged the electrical length of the whip greater than its physical length. The whip is made to resonate e.g. in the upper frequency band of the PIFA part. When the whip is in its pushed-in position, there is no significant coupling between it and the other parts of the antenna structure.

Figure 6:
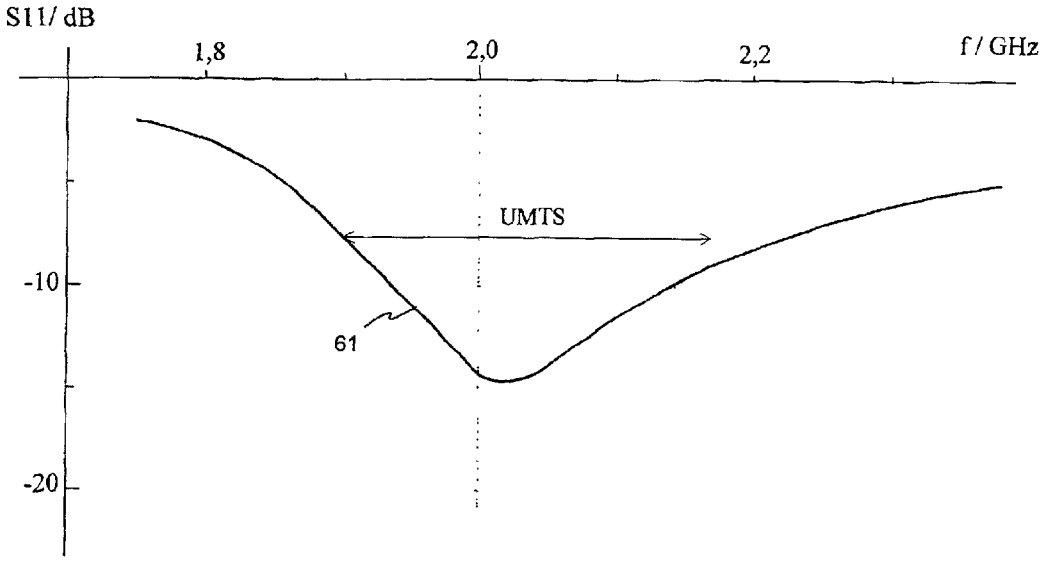
FIG. 6 shows an example of the frequency characteristics of an antenna according to the invention.

FIG. 6 shows an example of the frequency characteristics of an antenna according to the invention. It shows a curve 61 for the reflection coefficient S11 as a function of frequency. The antenna in question is designed for UMTS devices. The curve shows that in the UMTS frequency band the reflection coefficient of the antenna varies between −8 . . . −15 dB, which indicates relatively good matching and radiation power.

Figure 7:
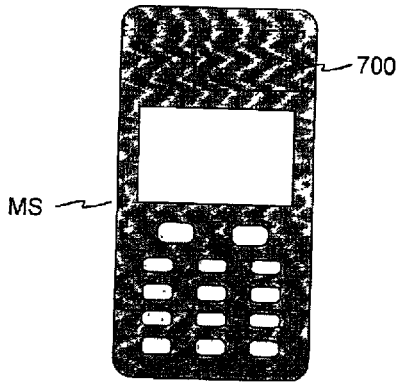
FIG. 7 shows an example of a mobile station equipped with an antenna according to the invention.

FIG. 7 shows a mobile station MS. It includes an antenna structure 700 according to the invention, located completely within the covers of the mobile station.

Above it was described some antenna structures according to the invention. The invention does not restrict the antenna element designs to those described above. Nor does the invention restrict in any way the manufacturing method of the antenna or the materials used therein. The inventional idea may be applied in different ways within the scope defined by the independent claim 1.

What is claimed is:

1. An antenna structure comprising a ground plane, one and only one planar feed element, one and only one planar parasitic element (230), one and only one feed conductor (203) and one and only one short-circuit conductor, the feed conductor being coupled to the feed element (240) and the short-circuit conductor being connected to the parasitic element, which, being larger in surface area than the planar feed element, is a main radiating element, and said feed element, which is not connected to the short-circuit conductor, being electromagnetically coupled to said parasitic element.

2. A structure according to claim 1, characterized in that said feed element is arranged to resonate at substantially the same frequency as said parasitic element.

3. A structure according to claim 1, characterized in that said parasitic element (230) and said feed element (240) are separate conductive regions on a surface of a dielectric plate (208).

4. A structure according to claim 1, characterized in that said parasitic element (330) and said feed element (340) are separate self-supporting conductive bodies.

5. A structure according to claim 1, characterized in that said parasitic element viewed from said short-circuit point (S), is divided into two branches having certain resonance frequencies.

6. A radio apparatus (MS) comprising an antenna (700) having a ground plane, one and only one planar feed element, one and only one planar parasitic element, one and only one feed conductor and one and only one short-circuit conductor, the feed conductor being coupled to the feed element and the short-circuit conductor being connected to the parasitic element, which, being larger in surface area than the planar feed element, is a main radiating element, and said feed element, which is not connected to the short circuit conductor, being electromagnetically coupled to said parasitic element, which parasitic element is short-circuited at a single point to the ground plane.

7. An antenna structure comprising a ground plane, planar feed element and a planar parasitic element, characterized in that said feed element (240) is coupled to a feed conductor (203) of the antenna structure and electromagnetically coupled to said parasitic element (230) which is short-circuited at a single point (S) to the ground plane, wherein the antenna structure additionally comprises a whip element which, when pulled out, is in galvanic contact with said feed element.

* * * * *